US005267693A

United States Patent [19]

Dickey

[11] Patent Number: 5,267,693

[45] Date of Patent: Dec. 7, 1993

[54] SPRAY GUN NON-STICK PAINT CONNECTOR BLOCK

[76] Inventor: Barry A. Dickey, 415 Ravenaux Dr., Southlake, Tex. 76092

[21] Appl. No.: 834,484

[22] Filed: Feb. 12, 1992

[51] Int. Cl.[5] ..... B05B 7/06

[52] U.S. Cl. ..... 239/417.3; 239/424.5; 239/526; 239/528

[58] Field of Search ..... 239/290, 291, 300, 526, 239/416.5, 423, 424, 424.5, 301, 417.3

[56] References Cited

U.S. PATENT DOCUMENTS

| | | | |
|---|---|---|---|
| 3,195,819 | 7/1965 | Watanabe | 239/290 |
| 3,733,030 | 5/1973 | Cartenson | 239/240 |
| 3,796,376 | 3/1974 | Farnsteiner | 239/353 |
| 4,359,192 | 11/1982 | Takahashi et al. | 239/488 |
| 4,934,602 | 6/1990 | Mattson | 239/300 |

FOREIGN PATENT DOCUMENTS

| | | | |
|---|---|---|---|
| 395790 | 11/1990 | European Pat. Off. | 7/89 |
| 48505 | 5/1985 | U.S.S.R. | 239/240 |

OTHER PUBLICATIONS

"Croix Turbine Spray Owner's Guide", Model CX710 Spray Gun.

Mark Clark, "Choosing the Right Spray Gun", reported in *BodyShop Business*, (Vol. 10, No. 10:90-92, Sep. 1991).

Mark Clark, "Efficient Paint Spraying Pays Off", reported in *Bodyshop Business*, (vol. 10, No. 12:88-90, Nov. 1991).

*Primary Examiner*—Andres Kashnikow
*Assistant Examiner*—Kevin Weldon
*Attorney, Agent, or Firm*—John W. Montgomery

[57] ABSTRACT

A liquid paint spray gun of the type having a barrel through which compressed air flows to a nozzle, a liquid outlet valve centrally positioned within the barrel adjacent the nozzle for providing a low pressure supply of liquid to be entrained and atomized in the pressurized air at the nozzle for spraying onto a surface, and an improved liquid supply connector block for supplying liquid to the liquid outlet valve, the improved connector block comprising a hollow central body portion having non-stick internal surfaces and a plurality of external projections from the central body portion spaced therearound for supporting the hollow central body axially aligned within the barrel with space therearound for compressed air to flow to the nozzle end of the barrel; an orifice through one of the external projections sealingly connectable to a pressurized liquid supply; and a valve assembly formed in the connector block for interconnecting the liquid outlet valve in fluid communication with the hollow body portion, for holding it adjacent the nozzle of the spray gun and for permitting the outlet valve to be opened at the nozzle without leaking liquid into the barrel.

10 Claims, 2 Drawing Sheets

SPRAY GUN NON-STICK PAINT CONNECTOR BLOCK

CROSS-REFERENCE TO RELATED APPLICATIONS

TECHNICAL FIELD OF THE INVENTION

The present invention relates to a spray gun liquid connector block and in particular, to a low pressure paint spray gun with a paint connector block fitted into the gun barrel and constructed to reduce paint sticking and to facilitate easy clean-up for re-use.

BACKGROUND OF THE INVENTION

There are currently low pressure paint guns, such as those manufactured by Croix Air Products, Inc., which when new and clean, adequately provide for smooth application of paints, lacquers, and the like. Such paint guns use a low pressure to push liquid paint, lacquer, and the like through a metered valve outlet and into a nozzle through which pressurized air is flowing. The air mixes with, atomizes, and entrains the paint, and projects the mixture for deposit onto a surface to be painted, such as an automobile, or the like. When a paint job is completed, the paint gun system must be cleaned to avoid clogging. When the paint job is completed, the air pressure is stopped and liquid paint remains in the spray gun connector block. Unless a solvent is flowed through the gun immediately, a film of paint remains on the internal mechanism. As the existing paint connector blocks are composed of metal, this problem is particularly acute for paint designed to adhere to metallic surfaces For example, auto body paint can leave a substantial layer of paint adhered to the internal surfaces of the connector block. The dried paint can change the size of the internal metered orifices and adversely affect adjustment and the operation of the paint gun. If the layers are allowed to solidify between multiple jobs, or if the paint remains in the gun for a long time, a sufficient deposit can build up, such that the gun is completely inoperative.

It has been found that even when a solvent is forced through the gun barrel immediately after use, a cured layer of paint sometimes remains in the connector block which is not dissolvable with a short period of solvent. Cleaning usually requires disassembly of the gun and mechanical scraping or rubbing to dislodge the adhered and dried paint.

SUMMARY OF THE INVENTION

It is an object of the present invention to provide a pressurized spray gun connector block and a paint flow system having reduced paint sticking characteristics. The connector block is constructed in a unique configuration which provides sufficient strength and alignment capabilities and is composed of reduced adhesion material.

It is a further object of the present invention to provide a liquid connector block and paint valve holder having reduced paint sticking characteristics and which is constructed to accept paint from a lower supply or paint through a gravity feed upper supply. The unique construction permits adequately sized connector orifices on the top and the bottom, either one of which may receive a non-stick connector fitting or be capped with a non-stick plug depending upon whether paint is supplied from below or from above.

BRIEF DESCRIPTION OF THE DRAWINGS

These and other features, objects, and advantages of the invention will become more evident with reference to the description, claims, and drawings below in which like reference numerals represent like elements and in which:

DETAILED DESCRIPTION OF THE DRAWINGS

Figure 1:
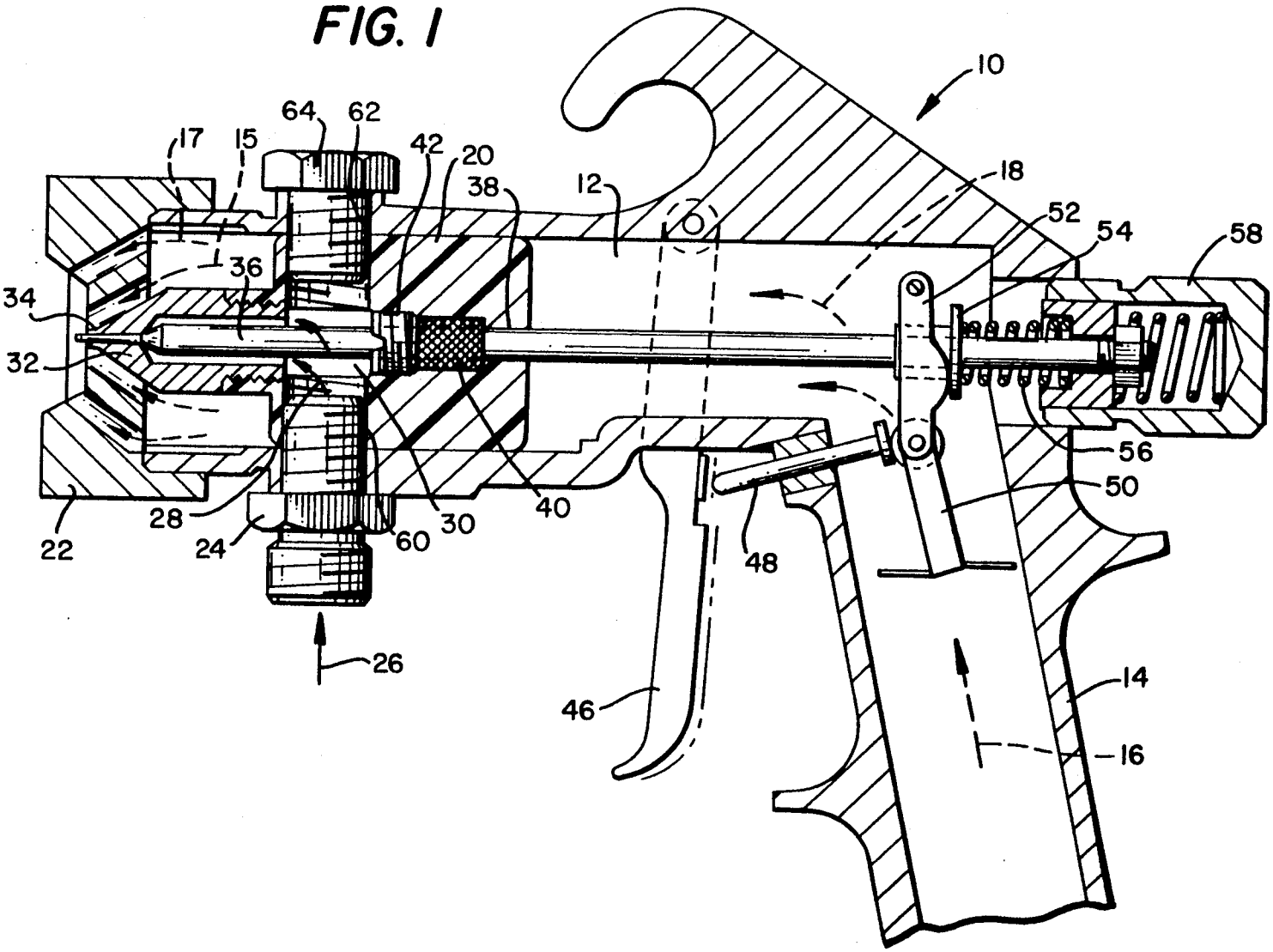
FIG. 1 is a side cross-sectional view of a paint spray gun with the inventive paint connector block in place, which cross-sectional view is taken along a vertical plane through the center line axis of the paint spray gun barrel.

FIG. 1 shows a side cross-sectional view taken along a vertical center line of a spray gun 10. Spray gun 10 is of the type having a hollow body which preferably comprises a cylindrical barrel section 12 which is interconnected to a handle section 14. Pressurized air, schematically indicated as arrow 16, flows in through the handle 14 and communicatingly flows into the barrel 12 at 18. The air flows past the liquid connector block 20 and out through nozzle 22, as shown schematically at arrows 15 and 17. The connector block 20 is connected in fluid communication through a fitting 24 to a liquid supply schematically depicted as arrow 26. Liquid supply 26 is preferably and typically a paint supply 26 and is preferably a sealed tank (not shown) which is pressurized with air pressure from barrel 12, as with a fitting and connector tube from the barrel to the supply tank. The liquid paint flows as indicated at arrows 28 through an interior bore 30 of connector block 20 and through an outlet valve 32 so that it is entrained and atomized in the air flow 15 of nozzle 22. It is further atomized and projected through air flow 17 onto a surface to be coated or painted with the liquid. The outlet opening 34 of the outlet valve assembly 32 is opened and closed with a needle valve 36 which projects through and preferably along the center line of connector block 20. The needle valve 36 is slidingly and sealingly held through an orifice 38 in the rear of connector block 20. A sealing means, such as a packing 40, is held in place with an adjustable packing hollow set screw 42. Block 20 is also constructed with a means 44 for connecting the valve tip 32 in alignment with rear orifice 38. For example, the valve tip connector means 44 may be a threaded portion formed on the interior surface of chamber 30, which threads extend a sufficient distance to allow rigid, sealing, and replaceable connection of tip 32 onto connector block 20.

In the operation of the spray gun 10, the preferred embodiment of the trigger 46 is depressible against a plunger 48 which acts through lever 50 to initiate pressurized air flow 16 (valve mechanism not depicted) Depression of trigger 46 and plunger 48 also acts through a pivoted lever 52 upon a portion 54 of needle 36 to draw needle 36 away from outlet opening 34 to allow the flow of liquid 28, such as paint, out through opening 34. Needle 36 is preferably adjustably spring-loaded, as at 58, to keep the opening 34 closed when trigger 46 is not activated. Spring loading 56 is also preferably adjustable at 58 so that the air flow 16 is initiated by movement of trigger 46 before needle 36 is extracted from valve opening 34. Thus, air flow is initiated prior to initiating liquid or paint flow.

The connector block 20 is advantageously constructed with a lower fitting connector opening 60 into which fitting 24 is sealingly connected as by threading to receive paint flow from below. Further, it has been found to be advantageous to also construct connector block 20 with an upper connector opening 62 for receiving paint from a paint cup positioned above the gun. In the embodiment shown (paint cup not shown), opening 62 is fitted with a plug 64. The plug 64 can be removed for attachment of a paint cup thereabove. In order to switch from a lower supply to an upper pressurized cup or an upper gravity feed supply, fitting 24 and plug 64 are removed. Plug 64 is placed in connector opening 60 and a fitting 24 or another fitting adapted for receiving a supply cup is fitted into connector 62. In this manner, a single spray gun 10 can be used both for long duration or extended painting, where a large supply 26 from below is desired, or may be used for low quantity touch-up jobs with a cup mounted above. This advantageously simple conversion was not previously available in known spray guns because of the construction of previous connector blocks which did not have projection extending from the top and bottom of barrel 12, and therefore did not have upper and lower openings 60 and 62.

Further, previous known spray gun connector blocks were not well adapted for quickly changing between one paint job and another, because of the extensive clean-out of the chamber 30 which was required between each usage. It will be noted that during use, small amounts of residual paint from a prior job could cause noticeable defects in a subsequent paint job of a different color. Previous connector blocks were constructed of metallic materials to which paints, and in particular, auto body paints, have high characteristic adhesion properties. During use of previously known paint guns, paint within the chamber of the connector block would stick to the interior surfaces and may even partially or completely cure, due to drying or catalytic activity between the paint and the metallic material. Running solvent through the gun for a period of time was not adequate to dissolve, dislodge, and remove all of the paint within the interior chamber of the paint connector block. This often resulted in flecks or speckles becoming dislodged during a subsequent painting operation, thereby adversely affecting the subsequent paint job. Adverse effects were particularly noticeable where a colored undercoating on an automobile was subsequently covered with a clear top coat. Even a very small quantity of pigmentation dislodged from the interior chamber of the connector block during the clear spraying operation was noticeable.

In the preferred embodiment, as will be more fully understood with reference to FIGS. 2 through 5 below, the improved connector block 20 is constructed with a non-stick polymer on all of its interior surfaces. Preferably and advantageously, non-stick interior surfaces are made by constructing the entire block of a non-stick polymer, such as TEFLON. The mechanical strength characteristics of such non-stick plastic or polymer materials are such that the structure of the improved connector block is uniquely designed to provide both adequate mechanical support through projections extending to the interior walls of barrel 12, and also to provide sufficient wall strength to withstand the maximum pressurization to which the connector block may be subjected.

In the preferred embodiment, fitting 24 and plug 64 are also coated with or preferably constructed of a plastic, polymer, or TEFLON material having non-stick characteristics, similar to that of the material of the connector block 20. Such a construction further facilitates ease of cleaning by merely flowing a small amount of solvent through the connector block after each use. Further advantages can be obtained with an entire paint supply system in which all of the interior surfaces to which paint is exposed are either constructed or coated with a non-stick polymer material such as TEFLON. However, the most difficult area of a paint gun system to clean is the connector block. Thus, significant advantages are obtained with standard existing paint guns provided with a unique low cost non-stick connector block according to the present invention to maximize versatility by facilitating the ease of clean-up between various painting operations.

Figure 2:
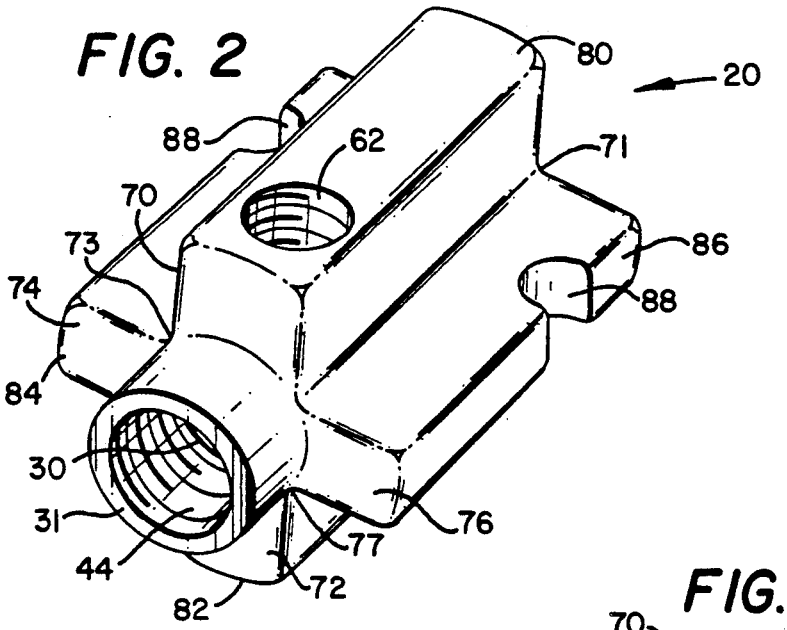
FIG. 2 is a perspective view of the liquid supply connector block according to the present invention.

Referring now to FIG. 2, which is a perspective view of the inventive connector block 20, a unique construction in which vertical projections 70 and 72 and horizontal projections 74 and 76 extend outwardly from a central bore or chamber 30 to form a cross shape in cross-section. Each of the projections 70, 72, 74, and 76 preferably have peripheral ends with exterior edges 80, 82, 84, and 86. Each of the exterior edges 80, 82, 84, and 86, when viewed from the end or in cross-section, defines a portion of an arc of a circle, such that if each of the arcs were continued, the exterior surfaces would define a cylinder of corresponding diameter to the interior of barrel 12. Both the upper projection 70 and the lower projection 72 have connector openings 60 (not shown in FIG. 2) and 62, which extend from exterior surfaces 80 and 82 into hollow chamber 30. The valve tip connector opening 44 is formed in the front end of connector block 20. It may project as a cylinder a short distance from the horizontal and vertical support projections to facilitate air flow.

In existing paint spray guns, pressurization of the paint supply 26 is usually accomplished with a tube communicating between the side of gun barrel 12 adjacent the connector block and the paint supply tank. In order to facilitate easy communication of existing pressure equalization tubes, a detent 88 may be formed in one of the side projections 76. A detent 88 may be formed, without adverse consequences, in both side projections 76 and 74. Formation of such detents 88 in both side projections facilitates universal orientation of the block within the gun barrel. The resulting bilateral symmetry of block 20 allows it to be positioned upside down without affecting operation of the paint spray gun.

Figure 3:
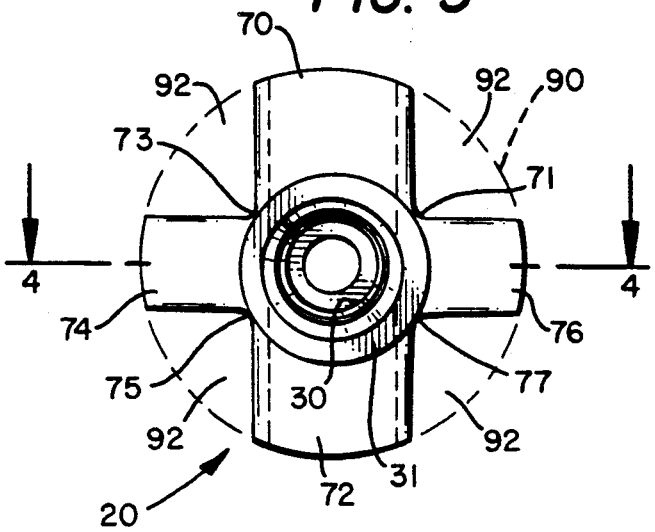
FIG. 3 is a front end view of the improved connector block according to the present invention.

With reference to FIG. 3, which is an end view of block 20, having the side walls 90 of gun barrel 12 depicted in phantom lines, the symmetrical cross shape of block 20 can be further understood. It is further evident in FIG. 3 that block 20 provides sufficient air passage space 92 around the exterior of block 20 to provide adequate air flow to nozzle 22 to entrain and atomize the paint.

In the preferred embodiment, the general cross shaped cross-section is formed with four projecting members 70, 72, 74, and 76 spaced apart at 90° intervals around the central bore 30 and the central body portion 31. The two vertical cross members 70 and 72 are preferably wider than the two side cross members 74 and 76 to allow the connector openings 60 and 62 to be formed therein with adequate side strength The two side projections 74 and 76 may be narrower or thinner than the two vertical projections. It has been found to be advantageous when constructing the connector block of a polymer, and particularly when constructing the connector block of a TEFLON material, that the width of the projections is adjusted so that they meet at their corners 71, 73, 75, and 77 around the body of the block which junctures are a sufficient distance from the central axis, so that the central bore or cylindrical chamber has a wall therearound which is sufficiently thick to withstand the maximum pressure to be asserted during the operation of the pressurized spray gun. A radius at the junctures further strengthens the construction. The cross member projections meet about the central body portion 31 to further rigidify the central body substantially completely around the body portion. Further, as the peripheral ends of each of the projections is preferably formed with an arc shape corresponding to the internal diameter of the paint spray gun barrel, the central body portion 31 is further strengthened and uniquely held inwardly from all directions by the strength of the gun barrel also.

Figure 4:
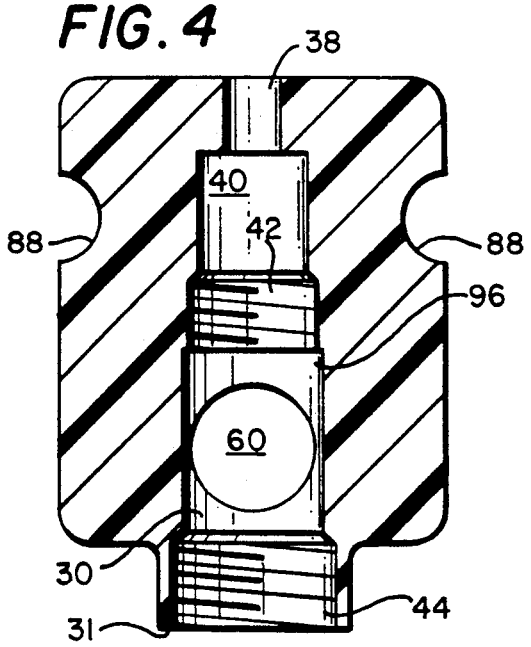
FIG. 4 is a bottom cross-sectional view of the improved connector block along section line 4—4 of FIG. 3.

With reference to FIG. 4, which is a cross-sectional view taken along line 44 of FIG. 2 horizontally through connector block 20, further advantageous features of the interior construction can be more fully understood. In particular, the preferred embodiment is constructed such that all the internal edges and corners are preferably radius, as at corners 96. Threaded connector opening 44, by which the nozzle tip is connected, is preferably threaded to a distant which allows the nozzle tip to "bottom out" at the last tread. Therefore, all of the thread lands in opening 44 are engaged with corresponding threads so that remaining pockets or cavities are minimized. Clearly, the advantage of having a non-stick polymer construction reduces the sticking and avoids problems even where square or non-rounded edges or where open threads remain. However, such potential paint collecting pockets are preferably minimized in the preferred construction.

Thus, what has been disclosed is an improved construction and system for low pressure paint spray guns which facilitates easy clean-up, and therefore, allows versatility of the spray gun. Further, the inventive spray gun allows both top feed and bottom feed with the same spray gun which further enhances the versatility engendered by the easy clean-up spray paint block connector.

While the invention has been disclosed in connection with a preferred embodiment, the disclosure is not intended to limit the invention to the particular embodiment described. Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed is:

1. An improved connector block for a liquid paint spray gun of the type having a barrel through which compressed air flows to a nozzle, a liquid outlet valve centrally positioned within the barrel adjacent the nozzle for providing a low pressure supply of liquid paint to be entrained an atomized in the pressurized air at the nozzle for spraying onto a surface, and an improved liquid supply connector block for supplying liquid to the liquid outlet valve, the improved connector block comprising:

(a) a hollow central body portion having non-stick internal surfaces formed of a polymer which has low adhesion to liquid paint and a plurality of external projections from the central body portion spaced therearound for supporting the hollow central body axially aligned within the barrel with space therearound for compressed air to flow to the nozzle end of the barrel;

(b) an orifice through one of the external projections sealingly connectable to a pressurized liquid supply; and (c) means formed in the connector block for interconnecting the liquid outlet valve in fluid communication with the hollow body portion, for holding it adjacent the nozzle of the spray gun and for permitting the outlet valve to be opened at the nozzle without leaking liquid into the barrel.

2. An improved connector block as in claim 1 wherein the non-stick polymer surfaces are composed of TEFLON.

3. A connector block as in claim 2 wherein the entire connector block is composed of TEFLON.

4. A connector block for a low pressure paint spray gun of the type having a barrel through which compressed air flows to a nozzle, a liquid outlet valve centrally positioned within the barrel adjacent the nozzle for providing a low pressure supply of liquid to be entrained and atomized in the pressurized air at the nozzle for spraying onto a surface, and an improved liquid supply connector block for supplying liquid to the liquid outlet valve, the improved connector block comprising:

(a) a hollow central body portion having non-stick internal surfaces and a plurality of external projections from the central body portion spaced therearound for supporting the hollow central body axially aligned within the barrel with space therearound for compressed air to flow to the nozzle end of the barrel;

(b) an orifice through one of the external projections sealingly connectable to a pressurized liquid supply and (c) means formed in the connector block for interconnecting the liquid outlet valve in fluid communication with the hollow central body portion, for holding it adjacent the nozzle of the spray gun and for permitting the outlet valve to be opened at the nozzle without leaking liquid into the barrel; and (d) wherein said connector block hollow central body and external projections are integrally formed in a block of polymer material composed entirely of TEFLON, including:

(i) a generally cross-shaped cross-section such that the ends of the cross-sectional cross shape form the projections;

(ii) a cylindrical bore axially along the intersection of the cross-sectional shape; and (iii) an orifice formed through one of said projections interconnecting with the cylindrical bore and having means at the end of the projection for sealing connection to the liquid paint supply.

5. An improved connector block as in claim 4 wherein said generally cross shaped cross-section further comprises one of said projections vertically upward from said cylindrical bore and another of said projections vertically downward from said cylindrical bore bilaterally symmetrical about a horizontal axis, each of said vertically upward and vertically downward projections having an orifice formed therethrough interconnecting with the cylindrical bore and having means at the end of the projection for sealing connection to a pair supply, or alternatively, to a plug.

6. An improved connector block for use in a low pressure liquid paint spray gun comprising:

(a) a body having a generally cross shaped cross-section such that the exterior ends of the cross-sectional cross shape form projections from a central portion of the cross shape;

(b) a cylindrical bore axially along the intersection of the cross-sectional cross shape having internal surfaces composed of a non-stick material formed of a polymer coating which has low adhesion to paint;

(c) the ends of the projections from the cross-sectional shape forming arcs of a circle which extend parallel to the axis of the bore to form cylindrical arc surfaces sized for insertion into a barrel of a liquid paint spray gun; and (d) a paint supply connector orifice formed through one of said projections interconnecting with the cylindrical bore and having threads for sealing connection to a paint supply fitting insertable through the wall of the paint spray gun barrel.

7. An improved connector block as in claim 6 wherein the non-stick polymer coating is a TEFLON.

8. An improved connector block as in claim 6 wherein the connector block is integrally formed of a polymer material having non-stick characteristics.

9. A connector block as in claim 8 wherein the entire connector block is composed of TEFLON.

10. In a low pressure paint spray gun system of the type having a spray gun with a barrel through which compressed air flows to a nozzle, a liquid outlet valve centrally positioned within the barrel adjacent the nozzle for providing a low pressure supply of paint to be entrained and atomized in the pressurized air at the nozzle and for spraying the entrained liquid onto a surface, the improvement comprising a construction having internal non-stick surfaces which are to be exposed to liquid paint during operation and wherein the internal non-stick surfaces comprise:

(a) a connector block composed of TEFLON;

(b) fittings into the connector block composed of TEFLON;

(c) a conduit between the connector block and the paint supply chamber composed of TEFLON; and (d) a lining in the paint supply chamber composed of TEFLON.

* * * * *

UNITED STATES PATENT AND TRADEMARK OFFICE

CERTIFICATE OF CORRECTION

PATENT NO. : 5,267,693
DATED : DECEMBER 7, 1993
INVENTOR(S) : BARRY A. DICKEY

It is certified that error appears in the above-indentified patent and that said Letters Patent is hereby corrected as shown below:

Column 1, line 34, insert - - . -- following "faces".

Column 2, line 62, insert - - . - - following "depicted)".

Column 5, line 4, insert - - . - - following "strength".

Column 5, line 68, replace "an" with - - and - -.

Column 7, line 8, replace "pair" with - - paint - -.

Signed and Sealed this

Thirty-first Day of May, 1994

Bruce Lehman

*Attest:*

BRUCE LEHMAN

*Attesting Officer*

*Commissioner of Patents and Trademarks*